US010662836B2

(12) United States Patent
Mitambo et al.

(10) Patent No.: US 10,662,836 B2
(45) Date of Patent: May 26, 2020

(54) INTEGRATED HEATER AND PRESSURE SENSOR FOR PCV SYSTEM

(71) Applicants: Pierre Mitambo, West Bloomfield, MI (US); Colton Wyatt, Lake Orion, MI (US)

(72) Inventors: Pierre Mitambo, West Bloomfield, MI (US); Colton Wyatt, Lake Orion, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 15/709,587

(22) Filed: Sep. 20, 2017

(65) Prior Publication Data

US 2019/0085742 A1 Mar. 21, 2019

(51) Int. Cl.
*F02M 51/06* (2006.01)
*F01M 13/00* (2006.01)

(52) U.S. Cl.
CPC ..... *F01M 13/00* (2013.01); *F01M 2013/0038* (2013.01); *F01M 2250/00* (2013.01)

(58) Field of Classification Search
CPC ..... F01M 13/00; F01M 2013/0038; F01M 2250/00
USPC ..... 123/572–574
See application file for complete search history.

(56) References Cited

U.S. PATENT DOCUMENTS

| | | | | |
|---|---|---|---|---|
| 4,686,952 | A | 8/1987 | Zeigler et al. | |
| 6,062,206 | A | 5/2000 | Nelson et al. | |
| 7,775,198 | B2 | 8/2010 | Shieh | |
| 8,087,403 | B2 | 1/2012 | Asanuma et al. | |
| 8,695,339 | B2 | 4/2014 | Spix | |
| 2001/0047801 | A1* | 12/2001 | Baeuerle | F01M 11/10 123/574 |
| 2006/0144376 | A1 | 7/2006 | Gschwind et al. | |
| 2006/0236989 | A1 | 10/2006 | Callahan | |
| 2013/0013171 | A1* | 1/2013 | Ghafari | F02M 25/06 701/104 |
| 2014/0076249 | A1 | 3/2014 | Rchinger et al. | |
| 2015/0275718 | A1* | 10/2015 | Jessberger | F02M 25/06 123/574 |
| 2016/0097354 | A1* | 4/2016 | Martus | F02M 35/10222 123/572 |

* cited by examiner

*Primary Examiner* — Marguerite McMahon
(74) *Attorney, Agent, or Firm* — Ralph E. Smith

(57) ABSTRACT

An integrated heater and pressure sensor assembly for a positive crankcase ventilation (PCV) system for a vehicle internal combustion engine includes a heater assembly configured to fluidly couple a PCV/makeup air (MUA) line and a vehicle air induction system line, the heater assembly configured to heat fluid passing into and out of the PCV/MUA line, and a pressure sensor assembly integrated directly into the heater assembly, the pressure sensor assembly configured to sense pressure pulsations in the PCV/MUA line.

19 Claims, 4 Drawing Sheets

INTEGRATED HEATER AND PRESSURE SENSOR FOR PCV SYSTEM

FIELD

The present application relates generally to positive crankcase ventilation (PCV) systems for internal combustion engines and, more particularly, to an integrated heater and pressure sensor for PCV systems.

BACKGROUND

Positive crankcase ventilation (PCV) systems are designed to evacuate blow-by gases from a crankcase of an internal combustion engine. These gases are formed of an air/fuel mixture that escapes the combustion chamber by "blowing by" the piston seals. To avoid corrosion and high pressures in the crankcase that can potentially damage the seals and increase pumping work, the blow-by gases must be vented therefrom. This is typically accomplished by returning the blow-by gases to the intake side of the internal combustion engine where the gases are mixed with the air/fuel mixture and subsequently burned. While current systems work well for their intended purpose, it is desirable to provide a simplified system with reduced cost and complexity.

SUMMARY

According to one example aspect of the invention, an integrated heater and pressure sensor assembly for a positive crankcase ventilation (PCV) system for a vehicle internal combustion engine is provided. The integrated assembly includes, in one exemplary implementation, a heater assembly configured to fluidly couple a PCV/makeup air (MUA) line and a vehicle air induction system line, the heater assembly configured to heat fluid passing into and out of the PCV/MUA line, and a pressure sensor assembly integrated directly into the heater assembly, the pressure sensor assembly configured to sense pressure pulsations in the PCV/MUA line.

In addition to the foregoing, the described integrated assembly may include one or more of the following features: wherein the pressure sensor assembly is removably coupled to the heater assembly; wherein the pressure sensor assembly is removably snap-fit to the heater assembly; wherein the heater assembly comprises a housing defining a passage therethrough, the passage configured to fluidly couple the PCV/MUA line and the air induction system line; and wherein the heater assembly housing comprises a main body portion, a clean side duct interface configured to couple to the air induction system line, and a PCV line interface configured to couple to the PCV/MUA line.

In addition to the foregoing, the described integrated assembly may include one or more of the following features: wherein the heater assembly housing comprises a heating element disposed within the passage: wherein the heater assembly housing further comprises an electrical connector electrically coupled to the heating element; wherein the heater assembly housing comprises a pressure sensor interface configured to receive the pressure sensor assembly; wherein the pressure sensor interface comprises a sensor support member, a plurality of retention clips extending outwardly from the sensor support member, and a sensor aperture configured to provide the pressure sensor assembly fluid communication with the housing passage; and wherein the pressure sensor assembly comprises a main sensor housing, a sensing tube configured to be inserted into the sensor aperture, and an electrical connector.

According to another example aspect of the invention, an internal combustion engine is provided. The engine includes, in one exemplary implementation, a crankcase; an air induction system having an air supply duct, a positive crankcase ventilation (PCV) system including a PCV/make-up air (MUA) line fluidly coupled between the crankcase and the air supply duct and configured to selectively vent blow-by gases from the crankcase and/or supply MUA to the crank case, and an integrated heater and pressure sensor assembly for the PCV system. The integrated heater and pressure sensor assembly includes a heater assembly fluidly coupled between the PCV/MUA line and the air supply duct, the heater assembly configured to heat fluid passing into and out of the PCV/MUA line, and a pressure sensor assembly integrated directly into the heater assembly, the pressure sensor assembly configured to sense pressure pulsations in the PCV/MUA line.

In addition to the foregoing, the described engine may include one or more of the following features: wherein the air induction system includes a turbocharger; wherein the integrated heater and pressure sensor assembly is fluidly coupled to the air supply duct upstream of the turbocharger; wherein integrated heater and pressure sensor assembly is welded directly to the air supply duct; wherein the pressure sensor assembly is removably coupled to the heater assembly; wherein the heater assembly comprises a housing defining a passage therethrough, the passage configured to fluidly couple the PCV/MUA line and the air induction system line; and wherein the heater assembly housing comprises a main body portion, a clean side duct interface configured to couple to the air supply duct; and a PCV line interface configured to couple to the PCV/MUA line, a heating element disposed within the passage, and a pressure sensor interface configured to receive the pressure sensor assembly.

In addition to the foregoing, the described engine may include one or more of the following features: wherein the pressure sensor interface comprises a sensor support member, a plurality of retention clips extending outwardly from the sensor support member, and a sensor aperture configured to provide the pressure sensor assembly fluid communication with the housing passage; and wherein the pressure sensor assembly comprises a main sensor housing, a sensing tube configured to be inserted into the sensor aperture, and an electrical connector.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

The present application is directed to an integrated heater and pressure sensor for a positive crankcase ventilation (PCV) system of an internal combustion engine. Because of reversal of crankcase gases in a make-up air (MUA) line of the PCV system, the MUA line includes a heater to ensure oil in the blow-by gases does not freeze. Because the PCV/MUA systems fall under emissions regulation, a pressure sensor is included to detect crankcase pulsations and identify any disconnect in the system. Until now, the pressure sensor was located on a remote portion of the MUA line and included a remote mounted hose and many additional components such as clips, fasteners, brackets. The present disclosure provides an integrated PCV heater and pressure sensor that improves detection of MUA line disconnects, greatly reduces the number of system components, and simplifies assembly thereof.

Figure 1:
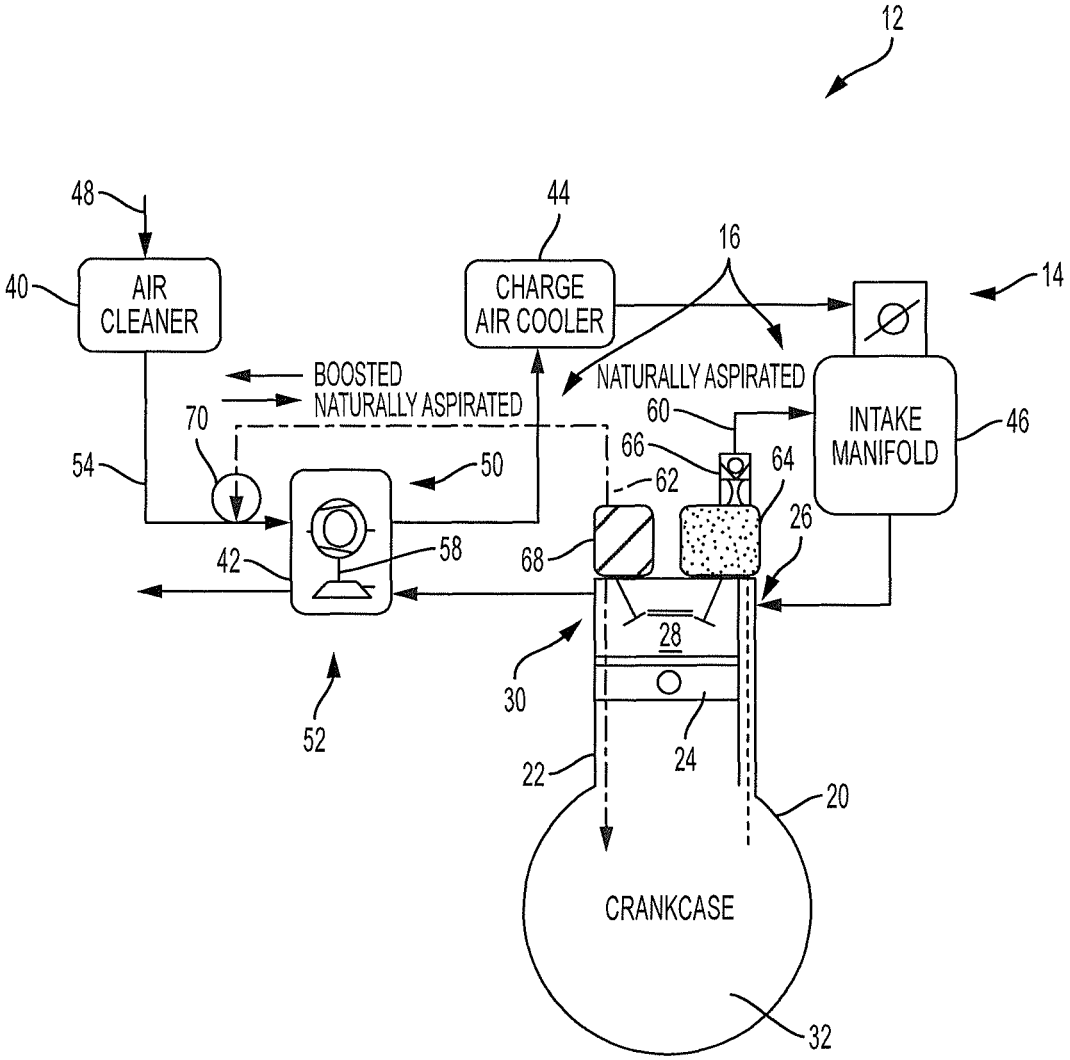
FIG. 1 is a schematic diagram of an example internal combustion engine having a PCV system, in accordance with the principles of the present disclosure.

Referring now to the drawings, FIG. 1 is a schematic illustration of an internal combustion engine 12 that generally includes a forced air induction system 14 and a PCV/MUA system 16.

The engine 12 generally includes a cylinder block 20 defining one or more cylinders 22 to each receive a reciprocating piston 24 therein. An intake port 26 supplies an air/fuel mixture from the forced air induction system 14 to a combustion chamber 28 within the cylinder 22. The air/fuel mixture is ignited in the combustion chamber 28 and the resulting exhaust gas is removed from the chamber via an exhaust port 30. During the combustion, a portion of the exhaust gas can blow by the piston 24 into a crankcase 32 of the engine. As described herein in more detail, the PCV system 16 recirculates the blow-by gases back to the forced air induction system 14 for further combustion in the combustion chamber 28.

The forced air induction system 14 generally includes an air cleaner 40, a turbocharger 42, a charge air cooler 44, and an intake manifold 46. Air enters the vehicle through an air intake 48 and is filtered in the air cleaner 40 before entering a compressor side 50 of the turbocharger 42. The air is compressed and subsequently cooled in the charge air cooler 44 before being delivered to the intake port 26 via the intake manifold 46. After combustion, the exhaust gas is removed from the combustion chamber 28 through exhaust port 30 before being directed to a turbine side 52 of the turbocharger 42. The exhaust gas drives the turbine side 52, which drives the turbocharger compressor side 50 via a shaft 58, and the exhaust gas is subsequently supplied to a vehicle exhaust aftertreatment system (not shown).

In the example embodiment, the PCV/MUA system 16 generally includes a PCV line 60 and a PCV/MUA line 62. The PCV line 60 is fluidly connected between the crankcase 32 and the intake manifold 46 to vent blow-by gases from the crankcase 32 to the intake manifold 46 under naturally aspirated conditions. PCV line 60 includes an oil separator 64 and a PCV valve 66. The oil separator 64 is configured to remove oil from the blow-by gases as they are directed from the crankcase 32 to the intake manifold 46, and PCV valve 66 is configured to regulate the flow of blow-by gases from the crankcase 32 to the intake manifold 46. Additionally, PCV valve 66 is configured to limit flow from the intake manifold 46 back to the crankcase 32 under boost conditions. As such, this is an intended boost leak meant to limit the vacuum present in the crankcase 32 (driven by the PCV/MUA line 62), which may increase pumping/frictional losses in the engine. The fresh air also flushes contaminants or debris just as the PCV/MUA line 62 provided under naturally aspirated conditions.

The PCV/MUA line 62 is fluidly connected between the crankcase 32 and a point of the forced air induction system 14 upstream of the turbocharger 42. In boosted conditions, PCV/MUA line 62 vents the blow-by gases from the crankcase 32 to the clean side duct 54 or the air cleaner 40. In un-boosted, naturally aspirated conditions, the PCV/MUA line 62 provides make-up air to the crankcase 32 to replace the blow-by gases vented through PCV line 60. PCV/MUA line 62 includes an oil separator 68 configured to remove oil form the blow-by gases as they are directed from the crankcase 32 upstream of the turbocharger 42. In the example embodiment, PCV/MUA line 62 further includes a combined or integrated heater and pressure sensor assembly 70, as described herein in more detail.

Figure 2:
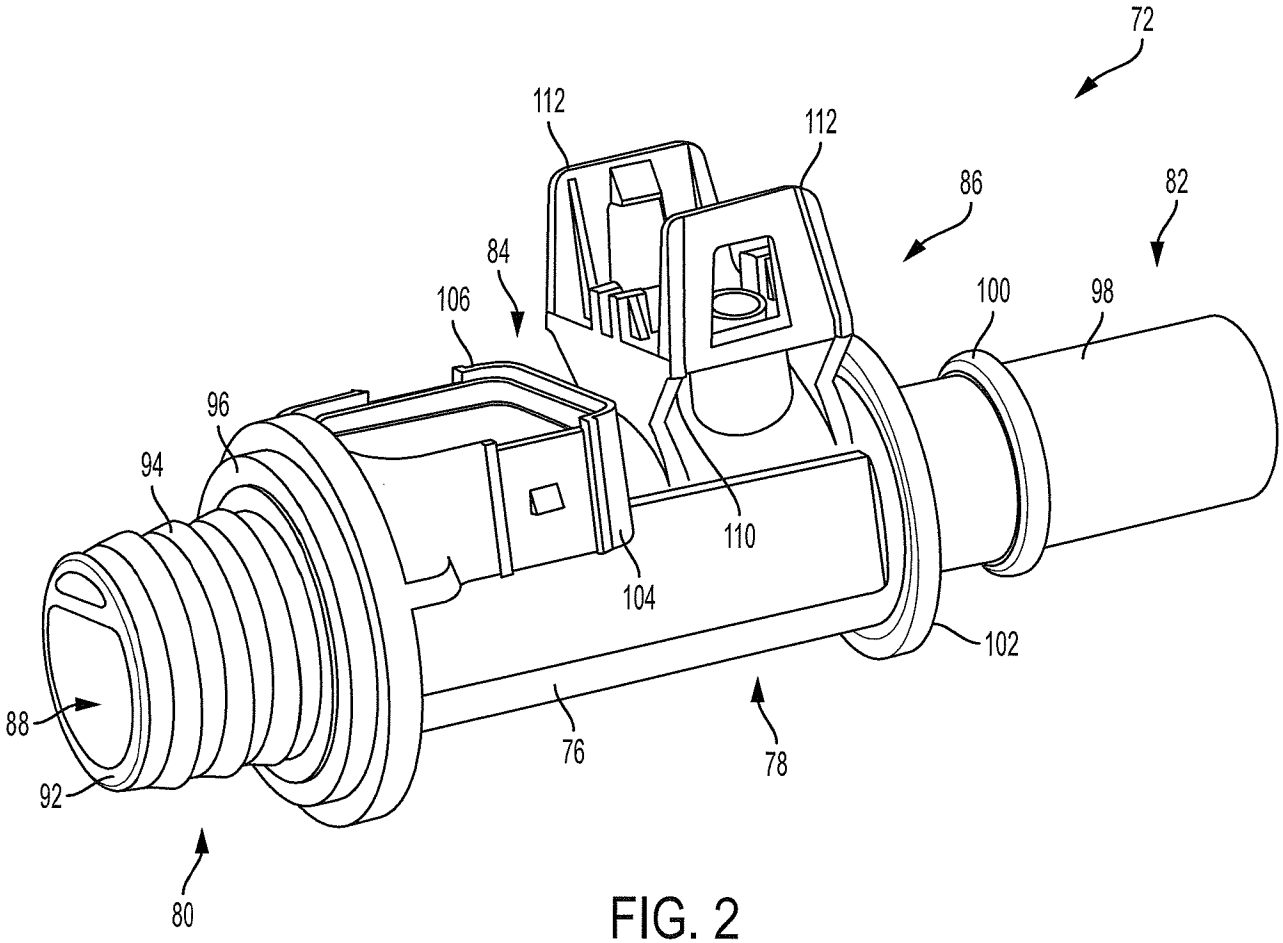
FIG. 2 is a perspective view of a first portion of an example integrated PCV heater and pressure sensor that may be utilized in the PCV system shown in FIG. 1, in accordance with the principles of the present disclosure.
Figure 3:
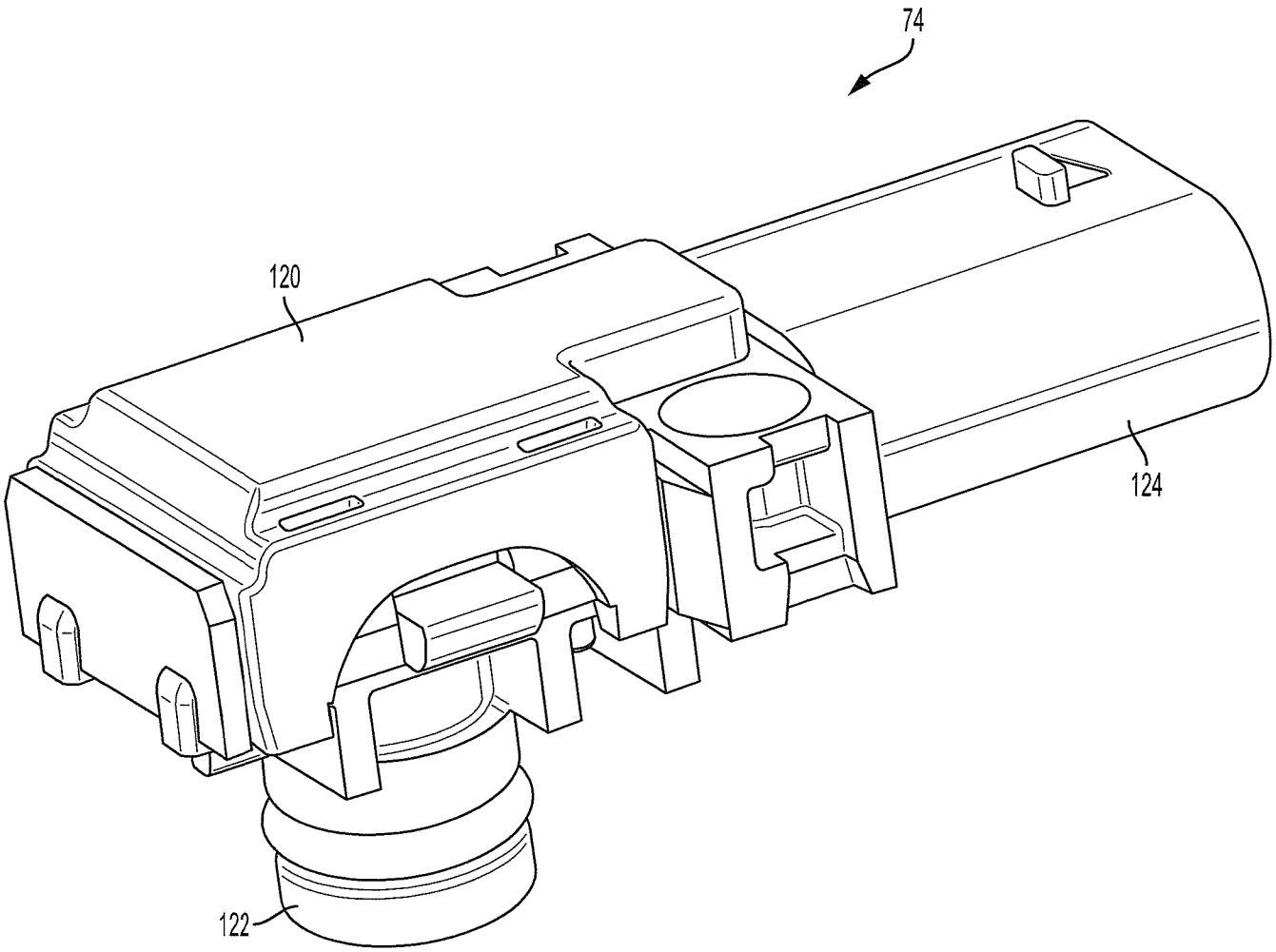
FIG. 3 is a perspective view of a second portion of the integrated PCV heater and pressure sensor that may be utilized in the PCV system shown in FIG. 1, in accordance with the principles of the present disclosure.
Figure 4:
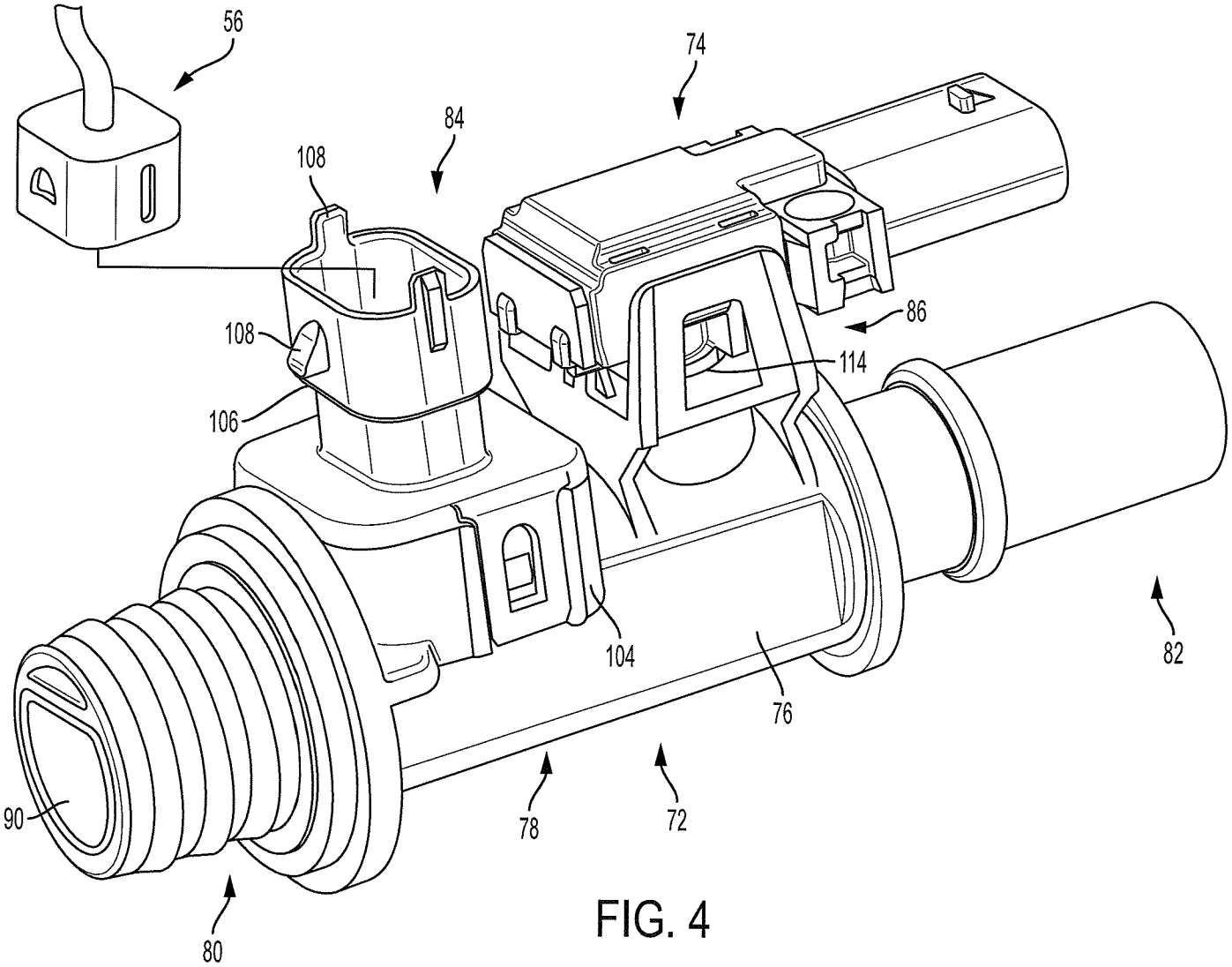
FIG. 4 is a perspective view of the integrated PCV heater and pressure sensor shown in FIGS. 2 and 3 after assembly, in accordance with the principles of the present disclosure.

With further reference to FIGS. 2-4, in one example implementation, the PCV/MUA system 16 includes integrated heater and pressure sensor assembly 70, which generally comprises a heater assembly 72 and a pressure sensor assembly 74.

With reference to FIGS. 2 and 4, the heater assembly 72 will be described in more detail. The heater assembly 72 is configured to heat air and/or blow-by gas supplied through PCV/MUA line 62 to prevent water or oil from freezing therein, which can damage the compressor wheel and/or obstruct flow in the forced air induction system 14 and/or the PCV/MUA system 16. In the example embodiment, heater assembly 72 generally includes a housing 76 having a main body portion 78, a clean side duct interface 80, a PCV/MUA line interface 82, an electrical connector 84, and a pressure sensor interface 86.

In the example embodiment, the housing 76 defines a port or passage 88 extending between interfaces 80, 82. Passage 88 is configured to direct intake air and blow-by gases between the PCV/MUA line 62 and a clean side duct 54 of the forced air induction system 14. As such, passage 88 fluidly connects PCV/MUA line 62 and the clean side duct 54.

A heating element 90 is disposed within passage 88 and is configured to electrically couple to an electrical connector 56, which provides power to heat the heating element 90. In the example embodiment, the heating element 90 is tubular and extends along at least a portion of an inner wall 92 defining the passage 88. In some embodiments, the heating element 90 extends into the passage 88 formed in one or more of the clean side duct interface 80 and the PCV line interface 82.

Clean side duct interface 80 is configured to couple to the clean side duct 54 and generally includes a tubular portion 94 and a stop surface 96 configured to receive a fitting of the clean side duct 54. In the example embodiment, stop surface 96 is also configured as a weld interface and/or a retention wall for a clamp coupling. In some embodiments, the clean side duct interface 80 is clamped or welded to the clean side duct 54. The PCV line interface 82 is configured to couple to the PCV/MUA line 62 and generally includes a tubular portion 98, a retention rib 100, and an end surface 102 configured to receive a fitting or tube of the PCV/MUA line 62.

In the example embodiment, electrical connector 84 is a female connector and extends outwardly from the main body portion 78. The electrical connector 84 is configured to removably couple to the male electrical connector 56 to provide power to the heating element 90. In the illustrated example, electrical connector 84 includes a base plate 104 and a hollow shell or fitting 106 extending outwardly therefrom. The hollow fitting 106 is configured to receive the electrical connector 56 therein and guide the electrical connector 56 into a position to establish an electrical connection between the electrical connector 56 and the heating element 90. In the example implementation, the hollow fitting 106 includes one or more tabs or retention member 108 configured to removably engage the electrical connector and prevent unintended disconnection thereof. However, electrical connector 84 can have any suitable structure that enables electrical connector 84 to removably couple with electrical connector 56.

In the example implementation, pressure sensor interface 86 generally includes a sensor support plate 110 and opposed retention clips 112. The sensor support plate 110 is coupled to main body portion 78 and defines a sensor aperture 114 that enables insertion of at least a portion of the pressure sensor assembly 74 into the passage 88 to take pressure readings from the fluid flow therein. The opposed retention clips 112 extend outwardly from the sensor support plate 110 and are configured to releasably couple the pressure sensor assembly 74 to the heater assembly 72. Although shown with opposed retention clips 112, pressure sensor interface 86 can have various constructions, including fasteners, which enable the heater assembly 72 to removably couple with various pressure sensors.

With reference to FIGS. 3 and 4, the pressure sensor assembly 74 will be described in more detail. The pressure sensor assembly 74 is configured to measure pressure pulsations of the blow-by gases as they travel through the PCV/MUA line 62 under boosted conditions to thereby detect if the PCV/MUA line 62 is disconnected from the clean side duct 54 of the forced air induction system 14. The pressure sensor assembly 74 generally includes a main sensor housing 120, a sensing tube 122, and an electrical connector 124. The main sensor housing 120 houses various pressure sensor components (not shown) configured to measure pressure in the PCV/MUA line 62. The sensing tube 122 is configured to be inserted into the sensor aperture 114 in order to establish fluid communication between the pressure sensor components and the PCV/MUA line 62. The electrical connector 124 is configured to couple to a connector (not shown) to provide electrical and/or signal communication with the vehicle. Accordingly, the pressure sensor assembly 74 is directly coupled to the heater assembly 72 to provide a simple and compact integrated PCV heater and pressure sensor assembly.

Described herein are systems and methods for a compact integrated PCV heater and pressure sensor assembly. The integrated assembly includes a pressure sensor assembly configured to releasably and directly couple to a heater assembly. This enables the pressure sensor assembly to quickly and easily snap-fit into the PCV heater, improve packaging, and reduce the number of components. Moreover, pressure sensor assembly is directly mounted to the heater assembly to detect pressure pulsations directly on the PCV/MUA line rather than from a remote mount that requires additional hose tubing for detection. As such, the integrated assembly reduces assembly time, cost, weight, packaging space, and number of components, as well as locates the pressure sensor assembly right at the hose connection to the air induction system to provide a more robust sensing position.

It should be understood that the mixing and matching of features, elements and/or functions between various examples may be expressly contemplated herein so that one skilled in the art would appreciate from the present teachings that features, elements and/or functions of one example may be incorporated into another example as appropriate, unless described otherwise above.

What is claimed is:

1. An integrated heater and pressure sensor assembly for a positive crankcase ventilation (PCV) system for a vehicle internal combustion engine, the integrated assembly comprising:

a heater assembly configured to fluidly couple a PCV/makeup air (MUA) line and a vehicle air induction system line, the heater assembly configured to heat fluid passing into and out of the PCV/MUA line; and a pressure sensor assembly integrated directly into the heater assembly, the pressure sensor assembly configured to sense pressure pulsations in the PCV/MUA line.

2. The integrated assembly of claim 1, wherein the pressure sensor assembly is removably coupled to the heater assembly.

3. The integrated assembly of claim 2, wherein the pressure sensor assembly is removably snap-fit to the heater assembly.

4. The integrated assembly of claim 1, wherein the heater assembly comprises a housing defining a passage therethrough, the passage configured to fluidly couple the PCV/MUA line and the air induction system line.

5. The integrated assembly of claim 4, wherein the heater assembly housing comprises:

a main body portion;

a clean side duct interface configured to couple to the air induction system line; and a PCV line interface configured to couple to the PCV/MUA line.

6. The integrated assembly of claim 4, wherein the heater assembly housing comprises a heating element disposed within the passage.

7. The integrated assembly of claim 6, wherein the heater assembly housing further comprises an electrical connector electrically coupled to the heating element.

8. The integrated assembly of claim 4, wherein the heater assembly housing comprises a pressure sensor interface configured to receive the pressure sensor assembly.

9. The integrated assembly of claim 8, wherein the pressure sensor interface comprises a sensor support member, a plurality of retention clips extending outwardly from the sensor support member, and a sensor aperture configured to provide the pressure sensor assembly fluid communication with the housing passage.

10. The integrated assembly of claim 9, wherein the pressure sensor assembly comprises:

a main sensor housing;

a sensing tube configured to be inserted into the sensor aperture; and an electrical connector.

11. An internal combustion engine comprising:

a crankcase;

an air induction system having an air supply duct;

a positive crankcase ventilation (PCV) system including a PCV/make-up air (MUA) line fluidly coupled between the crankcase and the air supply duct and configured to selectively vent blow-by gases from the crankcase and/or supply MUA to the crankcase; and an integrated heater and pressure sensor assembly for the PCV system, comprising:

a heater assembly fluidly coupled between the PCV/MUA line and the air supply duct, the heater assembly configured to heat fluid passing into and out of the PCV/MUA line; and a pressure sensor assembly integrated directly into the heater assembly, the pressure sensor assembly configured to sense pressure pulsations in the PCV/MUA line.

12. The engine of claim 11, wherein the air induction system includes a turbocharger.

13. The engine of claim 12, wherein the integrated heater and pressure sensor assembly is fluidly coupled to the air supply duct upstream of the turbocharger.

14. The engine of claim 13, wherein integrated heater and pressure sensor assembly is welded directly to the air supply duct.

15. The engine of claim 11, wherein the pressure sensor assembly is removably coupled to the heater assembly.

16. The engine of claim 11, wherein the heater assembly comprises a housing defining a passage therethrough, the passage configured to fluidly couple the PCV/MUA line and the air induction system line.

17. The engine of claim 16, wherein the heater assembly housing comprises:

a main body portion;

a clean side duct interface configured to couple to the air supply duct; and a PCV line interface configured to couple to the PCV/MUA line;

a heating element disposed within the passage; and a pressure sensor interface configured to receive the pressure sensor assembly.

18. The engine of claim 17, wherein the pressure sensor interface comprises a sensor support member, a plurality of retention clips extending outwardly from the sensor support member, and a sensor aperture configured to provide the pressure sensor assembly fluid communication with the housing passage.

19. The engine of claim 18, wherein the pressure sensor assembly comprises:

a main sensor housing;

a sensing tube configured to be inserted into the sensor aperture; and an electrical connector.

* * * * *